US009476112B2

(12) United States Patent
Miyanishi et al.

(10) Patent No.: US 9,476,112 B2
(45) Date of Patent: Oct. 25, 2016

(54) STEEL WIRE ROD OR STEEL BAR HAVING EXCELLENT COLD FORGEABILITY

(71) Applicant: NIPPON STEEL & SUMITOMO METAL CORPORATION, Tokyo (JP)

(72) Inventors: Kei Miyanishi, Tokyo (JP); Atsushi Monden, Tokyo (JP); Shingo Yamasaki, Tokyo (JP); Shunta Homma, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/389,991

(22) PCT Filed: Apr. 1, 2013

(86) PCT No.: PCT/JP2013/059935

§ 371 (c)(1),
(2) Date: Oct. 1, 2014

(87) PCT Pub. No.: WO2013/151009

PCT Pub. Date: Oct. 10, 2013

(65) Prior Publication Data

US 2015/0044086 A1 Feb. 12, 2015

(30) Foreign Application Priority Data

Apr. 5, 2012 (JP) ..... 2012-086844

(51) Int. Cl.
*C22C 38/02* (2006.01)
*C22C 38/04* (2006.01)
(Continued)

(52) U.S. Cl.
CPC ..... *C22C 38/60* (2013.01); *C21D 1/32* (2013.01); *C21D 8/06* (2013.01); *C21D 8/065* (2013.01);
(Continued)

(58) Field of Classification Search
None
See application file for complete search history.

(56) References Cited

U.S. PATENT DOCUMENTS 5,595,613 A 1/1997 Hatano et al.
6,602,359 B1 8/2003 Ochi et al.
(Continued)

FOREIGN PATENT DOCUMENTS

CN 1954088 A 4/2007
JP 7-242994 A 9/1995
(Continued)

OTHER PUBLICATIONS

Chinese Office Action and Search Report, issued Jun. 3, 2015, for Chinese Application No. 201380018247.X, with a partial English translation of the Chinese Office Action.
(Continued)

*Primary Examiner* — Deborah Yee
(74) *Attorney, Agent, or Firm* — Birch, Stewart, Kolasch & Birch, LLP

(57) ABSTRACT

A steel wire rod or steel bar as hot-rolled, including: by mass %: C: 0.1 to 0.6%, Si: 0.01 to 1.5%, Mn: 0.05 to 2.5%, Al: 0.015 to 0.3%, and N: 0.0040 to 0.0150%, and P: limited to 0.035% or less and S: limited to 0.025% or less, and the balance substantially consisting of iron and unavoidable impurities, wherein a depth of d (mm) from the surface of the surface layer region with 20 HV 0.2 or more higher, relative to HV 0.2 that is the average hardness in the region where the depth from the surface is from sectional radius R×0.5 (mm) to the center satisfies the formula (1); the steel structure of the surface layer region has a ferrite fraction of 10% or less by area ratio, with the balance being one or two or more of martensite, bainite and pearlite; the steel structure where the depth from the surface is from the sectional radius R×0.5 (mm) to the center is ferrite-pearlite or ferrite-bainite; and the surface roughness Ra in the circumferential direction when scales adhering to the surface have been removed is 4 μm or less.

20 Claims, 1 Drawing Sheet

(51) Int. Cl.

| | |
|---|---|
| ***C22C 38/06*** | (2006.01) |
| ***C21D 9/52*** | (2006.01) |
| ***C22C 38/60*** | (2006.01) |
| ***C21D 8/06*** | (2006.01) |
| ***C21D 1/32*** | (2006.01) |
| ***C22C 38/00*** | (2006.01) |
| ***C22C 38/18*** | (2006.01) |
| ***C22C 38/22*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/42*** | (2006.01) |

(52) U.S. Cl.

CPC ..... *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/24* (2013.01); *C22C 38/26* (2013.01); *C22C 38/28* (2013.01); *C22C 38/32* (2013.01); *C22C 38/42* (2013.01); *C21D 2211/002* (2013.01); *C21D 2211/005* (2013.01); *C21D 2211/008* (2013.01); *C21D 2211/009* (2013.01)

(56) References Cited

U.S. PATENT DOCUMENTS

| | | | |
|---|---|---|---|
| 2003/0075250 | A1 | 4/2003 | Ochi et al. |
| 2008/0041503 | A1 | 2/2008 | Torizuka et al. |

FOREIGN PATENT DOCUMENTS

| | | | |
|---|---|---|---|
| JP | 2000-212691 | A | 8/2000 |
| JP | 2001-89830 | A | 4/2001 |
| JP | 2001-181791 | A | 7/2001 |
| JP | 2001-240940 | A | 9/2001 |
| JP | 2001-240941 | A | 9/2001 |
| JP | 2002-146480 | A | 5/2002 |
| JP | 2005-220377 | A | 8/2005 |

OTHER PUBLICATIONS

International Search Report, mailed Jun. 11, 2013, issued in PCT/JP2013/059935.

Written Opinion of the International Searching Authority, mailed Jun. 11, 2013, issued in PCT/JP2013/059935.

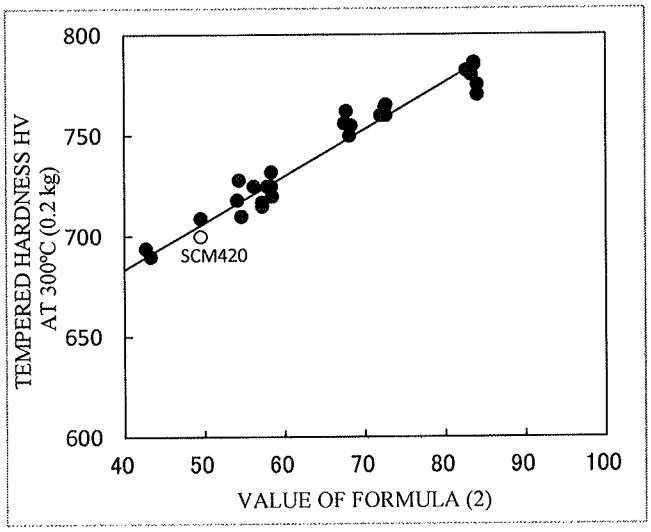
800
750
700
650
600
TEMPERED HARDNESS HV
AT 300°C (0.2 kg)
SCM420
40
50
60
70
80
90
100
VALUE OF FORMULA (2)

STEEL WIRE ROD OR STEEL BAR HAVING EXCELLENT COLD FORGEABILITY

TECHNICAL FIELD

The present invention relates to a steel wire rod or steel bar (including bar-in-coil; the same shall apply hereinafter) as hot-rolled having excellent cold forgeability after spheroidizing annealing. This application claims the priority right of Japanese Patent Application No. 2012-86844, filed in Japan on Apr. 5, 2012, and the content of which is incorporated herein.

BACKGROUND ART

Recently, there is a growing need for cold forging that can reduce or abbreviate machining such as cutting, for improvement in productivity. As compared to hot forging, cold forging has a problem that deformation resistance is high, and deformability (ductility) is poor, thus there are problems that mold crack and steel crack are likely to be caused.

Therefore, the steel material to be subjected to cold forging is generally subjected to spheroidizing annealing aiming at reducing deformation resistance and improving deformability. Patent Literature 1 discloses a wire rod or steel bar having excellent cold workability, that is softened by specifying the ferrite fraction to have low deformation resistance even as hot rolled.

In addition, it is known that deformability after spheroidizing annealing is strongly affected by a structure before spheroidizing annealing, i.e., pre-structure. For example, Patent Literature 2 discloses a method for improving deformability by using a pre-structure having a pro-eutectoid ferrite fraction of 5 to 30% by area, with the balance comprising a structure mainly consisting of bainite, and in which, also, the average value of the lath interval of cementite in the bainite is set to 0.3 μm or more. Also, Patent Literature 3 discloses "steel wire rod or bar steel for case hardening having excellent cold forgeability after spheroidizing" in which refinement of carbide is possible when performing spheroidizing annealing and having high deformability by having a mixed structure comprising ferrite, bainite and pearlite and specifying the area fraction of the bainite to 30% or more. In addition, Patent Literature 4 discloses an invention in consideration of preventing crack during cold working for the structure after spheroidizing annealing by specifying the ferrite fraction of the surface layer structure to 10% or less.

PRIOR ART LITERATURES

Patent Literatures

[Patent Literature 1] JP 2002-146480A
[Patent Literature 2] JP 2001-89830A
[Patent Literature 3] JP 2005-220377A
[Patent Literature 4] JP 2001-181791A

SUMMARY OF THE INVENTION

Problems to be Solved by the Invention

Patent Literature 1 is originally a technique that can omit annealing, and, different from a technique of preventing crack of steel material that is an essential problem in cold working with high working degree, is not a technique to improve the crack of steel material.

The methods disclosed in Patent Literature 2, Patent Literature 3 and Patent Literature 4 relate to a technique of preventing crack of steel material that is an essential problem in cold working with high working degree. However, also regarding these methods, there has been still a room for further improvement for preventing crack. The present invention has been made in consideration of the problems described above, and an object of the present invention is to provide a steel wire rod or steel bar for cold forging as hot-rolled having excellent ductility after spheroidizing annealing, that can prevent crack of steel material that is an inhibiting factor of cold forging in working with further higher working degree.

Means for Solving the Problems

The present inventors have intensively studied, and consequently found that it is useful for improving deformability to prevent the crack of steel material during cold forging to appropriately control the surface roughness of the steel basis material, in addition to the steel material component and pre-structure before spheroidizing annealing.

The present invention has been made based on the above novel knowledge, and the gist of the present invention is as described below.

[1]

A steel wire rod or steel bar as hot-rolled, having excellent cold forgeability, including, by mass %, as a chemical composition, C: 0.1 to 0.6%, Si: 0.01 to 1.5%, Mn: 0.05 to 2.5%, Al: 0.015 to 0.3%, N: 0.0040 to 0.0150%, and P: limited to 0.035% or less, S: limited to 0.025% or less, and the balance substantially consisting of iron and unavoidable impurities, wherein a depth of d (mm) from the surface of the surface layer region with 2Q HV 0.2 or more higher, relative to HV 0.2 that is the average hardness in the region where the depth from the surface is from sectional radius R×0.5 (mm) to the center satisfies the following formula (1); the steel structure of the surface layer region has a ferrite fraction of 10% or less by area ratio, with the balance being one or two or more of martensite, bainite and pearlite; the steel structure where the depth from the surface is from the sectional radius R×0.5 (mm) to the center is ferrite-pearlite or ferrite-bainite; and the surface roughness Ra in the circumferential direction when scales adhering to the surface have been removed is 4 μm or less.

$$0.5 \geq d/R \geq 0.03 \quad (1)$$

[2]

The steel wire rod or steel bar according to [1], further including one or two or more of, by mass %, as the chemical composition of the steel, Cr: 3.0% or less, Mo: 1.5% or less, Cu: 2.0% or less, Ni: 5.0% or less, and B: 0.0035% or less.

[3]

The steel wire rod or steel bar according to [1] or [2], further including one or two or more of, by mass %, as the chemical composition of the steel, Ca: 0.005% or less, Zr: 0.005% or less, Mg: 0.005% or less, and Rem: 0.015% or less.

[4]

The steel wire rod or steel bar according to any of [1] to [3], further including one or two or more of, by mass %, as the chemical composition of the steel, Ti: 0.20% or less, Nb: 0.1% or less, V: 1.0% or less, and W: 1.0% or less.

[5]

The steel wire rod or steel bar according to any of [1] to [4], further including one or two or more of, by mass %, as a chemical composition of the steel, Sb: 0.0150% or less, Sn: 2.0% or less, Zn: 0.5% or less, Te: 0.2% or less, Bi: 0.5% or less, and Pb: 0.5% or less.

[6]

The steel wire rod or steel bar according to any of [1] to [5], further satisfying the following formula (2), by mass %, as the chemical composition of the steel.

$$31Si+15Mn+23Cr+26Mo+100V \geq 55 \quad \text{Formula (2)}$$

[7]

The steel wire rod or steel bar according to any of [1] to [6], further including, by mass %, as the chemical composition of the steel, Ti: 0.02 to 0.20% and B: 0.0005 to 0.0035%.

Effects of the Invention

The steel wire rod or steel bar of the present invention can prevent crack of steel material that occurs during cold forging. The present invention can realize cold forging with high working degree that is conventionally impossible, or abbreviate intermediate annealing of the step in which cold forging is conventionally impossible without intermediate annealing.

BRIEF DESCRIPTION OF THE DRAWING

FIG. 1 is a graph showing a relationship between the value of formula (2) and tempered hardness at 300° C.

MODES FOR CARRYING OUT THE INVENTION

Hereinafter, embodiments for carrying out the present invention will be described in detail. First, the reason for limiting the chemical composition of the present invention will be described. Hereinafter, % by mass in the composition is simply denoted by %.

C: 0.1 to 0.6%

C is an element having a major effect on the basic strength of the steel material. However, in a case where the C content is less than 0.1%, a sufficient strength cannot be obtained, and other alloy elements must be further added in large amounts. On the other hand, with a C content exceeding 0.6%, the material hardness increases, and deformation resistance markedly increases, resulting in significant degradation in machinability. Accordingly, in the present invention, the C content is set to 0.1 to 0.6%. The preferred range is from 0.4 to 0.6%.

Si: 0.01 to 1.5%

Si is an element effective for deoxidization of steel, and is also an element effective for strengthening ferrite and improving temper softening resistance. With Si less than 0.01%, the effects are insufficient. On the other hand, with Si exceeding 1.5%, the steel becomes brittle, material characteristics degrade, also, machinability significantly deteriorates, and further, carburizing properties are inhibited. Accordingly, the Si content needs to be set in the range of 0.01 to 1.5%. The preferred range is from 0.05 to 0.40%.

Mn: 0.05 to 2.5%

Mn fixes and disperses S in steel as MnS. Also, Mn is an element necessary to improve hardenability and secure strength after quenching by forming a solid solution in the matrix. However, with an Mn content of less than 0.05%, S in steel bonds with Fe so as to form FeS, and the steel becomes brittle. On the other hand, when the Mn content increases, specifically, the Mn content exceeds 2.5%, the hardness of the basis material increases, cold workability degrades, and also the effects on strength and hardenability are also saturated. Accordingly, the Mn content is set to 0.05% to 2.5%. The preferred range is from 0.30 to 1.25%.

Al: 0.015 to 0.3%

Al is effective for, besides deoxidization of steel, fixation of solid solution N present in steel as AlN, and crystal grain refinement. Also, when B is contained, it is useful for securing solid solution B. In order to obtain the above effects, 0.015% or more of Al is required. However, with a content exceeding 0.3%, $Al_2O_3$ is excessively produced, and degradation of fatigue strength and cold forging crack are caused, thus the Al content is set to 0.015% to 0.3%.

N: 0.0040 to 0.0150%

N bonds with Al, Ti, Nb and V in steel to produce nitride or carbonitride, and suppresses coarsening of crystal grain. In addition, with a content less than 0.0040%, the effect is insufficient. However, with a content exceeding 0.0150%, the effect is saturated, and also non-solid solution carbonitride does not form a solid solution and remains during heating before hot rolling or hot forging, thus it is difficult to increase the amount of fine carbonitride effective to suppress coarsening of crystal grain. Accordingly, the content thereof needs to be set in the range of 0.0040 to 0.0150%.

P: 0.035% or less

When the P content increases, specifically, with a P content exceeding 0.035%, the hardness of the basis material increases in steel, and cold workability, hot workability and casting characteristics also degrade. Accordingly, the P content is set to 0.035% or less. The preferred range is 0.02% or less.

S: 0.035% or less

With an S content exceeding 0.035%, MnS is coarsened, and becomes a starting point of crack during cold working. For the above reason, the S content needs to be set to 0.035% or less. The preferred range is 0.01% or less.

Furthermore, as optionally contained elements, for improving hardenability and imparting strength, one or two or more of Cr: 3.0% or less, Mo: 1.5% or less, Cu: 2.0% or less, Ni: 5.0% or less and B: 0.0035% or less may be contained.

Cr: 3.0% or less

Cr is an element for improving hardenability and also imparting temper softening resistance, and is added to steel in which a high strength is required. In order to stably improve hardenability, the Cr content is desirably 0.1% or more. Also, when Cr is contained in an amount exceeding 3.0%, Cr carbide is produced, and steel becomes brittle. Accordingly, in the present invention, when Cr is contained, the content thereof is set to 3.0% or less. The preferred range is from 0.1 to 2.0%.

Mo: 1.5% or less

Mo is an element for imparting temper softening resistance and also improving hardenability, and is added to steel in which a high strength is required. In order to stably improve hardenability, the Mo content is desirably 0.01% or more. Also, even when Mo is contained in an amount exceeding 1.5%, the effects are saturated. Accordingly, when Mo is contained, the content thereof is set to 1.5% or less. The preferred range is from 0.05 to 0.25%.

Cu: 2.0% or less

Cu is an element effective for strengthening ferrite and also improving hardenability and improving corrosion resistance. In order to stably improve hardenability and corrosion resistance, the Cu content is desirably 0.1% or more. Also, even when Cu is contained in an amount exceeding 2.0%, the effects are saturated in terms of mechanical properties. Accordingly, when Cu is contained, the content thereof is set to 2.0% or less. Meanwhile, Cu particularly degrades hot ductility, and causes defect during rolling, and thus is preferably added together with Ni.

Ni: 5.0% or less

Ni is an element effective for strengthening ferrite, improving ductility and also improving hardenability and improving corrosion resistance. In order to stably improve hardenability and corrosion resistance, the Ni content is desirably 0.1% or more. Also, even when Ni is contained in an amount exceeding 5.0%, the effects are saturated in terms of mechanical properties, and machinability degrades. Accordingly, when Ni is contained, the content thereof is set to 5.0% or less.

B: 0.0035% or less

Solid solution B improves hardenability and also improves grain boundary strength, and improves fatigue strength and impact strength as machine parts. In order to stably improve hardenability and cold workability, the B content is desirably 0.0005% or more. Also, even when B is contained an amount exceeding 0.0035%, the effects are saturated in terms of mechanical properties, and further, hot ductility markedly degrades. Accordingly, when B is contained, the content thereof is set to 0.0035% or less.

Furthermore, as optionally contained elements, one or two or more of Ca, Zr, Mg and Rem may be contained.

Ca: 0.005% or less

Ca is a deoxidizing element, and produces an oxide. In steel containing 0.015% or more as total Al (T-Al) as in the steel of the present invention, calcium aluminate ($CaOAl_2O_3$) is formed when Ca is contained. $CaOAl_2O_3$ is an oxide having a lower melting point as compared to $Al_2O_3$, thus serves as a tool protective film during high-speed cutting, and improves machinability. In order to stably improve machinability, the Ca content is desirably 0.0002% or more. Also, with a Ca content exceeding 0.005%, CaS is produced in steel, and conversely, machinability degrades. Accordingly, when Ca is contained, the content thereof is set to 0.005% or less.

Zr: 0.005% or less

Zr is a deoxidizing element, and produces an oxide in steel. The oxide is considered to be $ZrO_2$, and this $ZrO_2$ becomes a precipitation nucleus of MnS, thus has effects of increasing the precipitation sites of MnS and uniformly dispersing MnS. In addition, Zr also has an action of forming a solid solution in MnS so as to produce a complex sulfide, lower deformability, and suppress stretching of MnS during rolling and hot forging. As such, Zr is an element effective for reducing the anisotropy. In order to stably obtain these effects, the Zr content is desirably 0.0003% or more. On the other hand, even when Zr is contained in an amount exceeding 0.005%, the yield becomes extremely poor so as to produce large amounts of hard compounds such as $ZrO_2$ and ZrS, and conversely, mechanical properties such as machinability, impact values and fatigue characteristics degrade. Accordingly, when Zr is contained, the content thereof is set to 0.005% or less.

Mg: 0.005% or less

Mg is a deoxidizing element, and produces an oxide in steel. Moreover, hard $Al_2O_3$ is modified into MgO or $Al_2O_3.MgO$, which is relatively soft and finely dispersed to improve machinability. In addition, an oxide thereof is liable to become a nucleus of MnS, and also has an effect of finely dispersing MnS. In order to stably obtain these effects, the Mg content is desirably 0.0003% or more. Also, Mg produces a complex sulfide with MnS and spheroidize MnS; however, when Mg is excessively contained, specifically, with an Mg content exceeding 0.005%, the production of sole MgS is accelerated and conversely deteriorates machinability. Accordingly, when Mg is contained, the content thereof is set to 0.005% or less.

Rem: 0.015% or less

Rem (rare earth element) is a deoxidizing element, produces an oxide having a low melting point, and suppresses nozzle clogging during casting, and also has an action of forming a solid solution in MnS or bonds with MnS, lower the deformability thereof, and suppress stretching of the MnS shape during rolling and hot forging. As such, Rem is an element effective for reducing the anisotropy. In order to stably obtain these effects, the Rem content is desirably 0.0001% or more. Also, with Rem is contained in an amount exceeding 0.015%, a large amount of a sulfide of Rem is produced, and machinability deteriorates. Accordingly, when Rem is contained, the content thereof is set to 0.015% or less.

Furthermore, as optionally contained elements, one or two or more of Ti, Nb, V and W may be contained.

Ti: 0.20% or less

Ti is an element that forms carbonitride, contributes to suppression of the growth or strengthening of austenite grains, and is used as a granulating element for preventing coarsening of grains in steel in which a high strength is required and steel in which a low strain is required. In addition, Ti is also a deoxidizing element, and has an effect of forming a soft oxide so as to improve machinability. In order to stably obtain the above effects, the content is preferably 0.001% or more. In addition, with a Ti content exceeding 0.1%, a non-solid solution coarse carbonitride which causes hot cracking is precipitated, and conversely, mechanical properties are impaired. Accordingly, when Ti is contained in the present invention, the content thereof is set to 0.20% or less. The preferred range is from 0.001 to 0.20%.

Nb: 0.1% or less

Nb is also an element that forms carbonitride, contributes to strengthening of steel through secondary precipitation hardening, and suppression of the growth and strengthening of austenite grains, and is used as a granulating element for preventing coarsening of grains in steel in which a high strength is required and steel in which a low strain is required. In order to stably obtain the effect of increasing the strength, the Nb content is desirably 0.01% or more. In addition, when Nb is contained in an amount exceeding 0.1%, a non-solid solution coarse carbonitride which causes hot cracking is precipitated, and conversely, mechanical properties are impaired. Accordingly, when Nb is contained, the content thereof is set to 0.1% or less.

V: 1.0% or less

V is also an element that forms carbonitride and can strengthen steel through secondary precipitation hardening, and is contained in steel in which a high strength is required. However, in order to stably obtain the effect of increasing the strength, the V content is desirably 0.03% or more. In addition, when V is contained in an amount exceeding 1.0%, a non-solid solution coarse carbonitride which causes hot cracking is precipitated, and conversely, mechanical properties are impaired. Accordingly, when V is contained, the content thereof is set to 1.0% or less.

W: 1.0% or less

W is also an element that forms carbonitride and can strengthen steel through secondary precipitation hardening. In order to stably obtain the effect of increasing the strength, the W content is desirably 0.01% or more. In addition, when W is contained in an amount exceeding 1.0%, a non-solid solution coarse carbonitride which causes hot cracking is precipitated, and conversely, mechanical properties are impaired. Accordingly, when W is contained, the content thereof is set to 1.0% or less.

Furthermore, as optionally contained elements, one or two or more of Sb, Sn, Zn, Te, Bi and Pb may be contained.

Sb: 0.0150% or less

Sb makes ferrite brittle to an appropriate extent, and improves machinability. In order to stably obtain the effect of improving machinability, the Sb content is desirably 0.0005% or more. In addition, when the Sb content increases, specifically, exceeds 0.0150%, the macro segregation of Sb becomes excessive, and the impact value significantly decreases. Accordingly, the Sb content is set to 0.0150% or less.

Sn: 2.0% or less

Sn has effects of making ferrite brittle so as to extend the service life of a tool and improving the surface roughness. In order to stably obtain these effects, the Sn content is desirably 0.005% or more. Also, even when Sn is contained in an amount exceeding 2.0%, the effects are saturated. Accordingly, when Sn is contained, the content thereof is set to 2.0% or less.

Zn: 0.5% or less

Zn has effects of making ferrite brittle so as to extend the service life of a tool and improving the surface roughness. In order to stably obtain these effects, the Zn content is desirably 0.0005% or more. Also, even when Zn is contained in an amount exceeding 0.5%, the effects are saturated. Accordingly, when Zn is contained, the content thereof is set to 0.5% or less.

Te: 0.2% or less

Te is a machinability-improving element. In addition, Te has an action of producing MnTe, and coexisting with MnS so that the deformability of MnS degrades and stretching of the MnS shape is suppressed. As such, Te is an effective element for reducing anisotropy. In order to stably obtain these effects, the Te content is desirably 0.0003% or more. In addition, with a Te content exceeding 0.2%, not only is the effect saturated, but hot ductility also degrades such that it is highly likely that defects are caused. Accordingly, when Te is contained, the content thereof is set to 0.2% or less.

Bi: 0.5% or less

Bi is a machinability-improving element. In order to stably obtain the effect of improving machinability, the Bi content is desirably 0.005% or more. In addition, even when Bi is contained in an amount exceeding 0.5%, not only is the machinability-improving effect saturated, but hot ductility also degrades such that it is highly likely that defects are caused. Accordingly, when Bi is contained, the content thereof is set to 0.5% or less.

Pb: 0.5% or less

Pb is a machinability-improving element. In order to stably obtain the effect of improving machinability, the Pb content is desirably 0.005% or more. In addition, even when Pb is contained in an amount exceeding 0.5%, not only is the machinability-improving effect saturated, but hot ductility also degrades such that it is highly likely that defects are caused. Accordingly, when Pb is contained, the content thereof is set to 0.5% or less.

In addition to the above composition range, Si, Mn, or further one or two or more of Cr, Mo and V are contained so as to satisfy the following formula (2), whereby the steel wire rod or steel bar of the present invention can be molded to, for example, a gear, by cold forging, and then when carburized, quenched and tempered and used, softening resistance after carburizing quenching and tempering is increased, and high temperature hardness can be kept high, and it is possible to improve the surface fatigue strength. The gear instantaneously reaches about 300° C. by the friction when meshing, thus softening at tempering of 300° C. is suppressed and the hardness is secured, whereby it is possible to manufacture gear parts having further excellent surface fatigue strength.

Si, Mn, Cr, Mo and V are conventionally efficient for temper softening resistance. In the level of steel 30 with a component composition of C: 0.11 to 0.60% (% by mass, the same shall apply hereinafter.), Si: 0.10 to 1.5%, Mn: 0.05 to 2.46%, P: 0.01 to 0.03%, S: 0.007 to 0.01%, Al: 0.02 to 0.025%, Cr: 0 to 3.0%, Mo: 0 to 1.5%, V: 0 to 0.4% and N: 0.0040 to 0.0140%, as a result of investigating tempered hardness at 300° C. of the steel material by performing carburizing, quenching and tempering (quenching was performed after gas carburizing in the conditions of 950° C.×300 minutes and a carbon potential of 0.8, then tempering at 150° C.×90 minutes was performed.) and then retaining the steel at 300° C.×90 minutes, it has been found that there is a certain relationship between the value of formula (2) and tempered hardness at 300° C., as shown in FIG. 1. Based on FIG. 1, the value of the formula (2) is set to 55 or more, whereby it is possible to obtain tempered hardness of JIS SCM 420 or more at 300° C., commonly used as a gear.

$$31Si+15Mn+23Cr+26Mo+100V \geq 55 \quad \text{Formula (2)}$$

When B: 0.0005 to 0.0035% and Ti: 0.02 to 0.20% are contained, B improves hardenability, and Ti fixes N as TiN to suppress production of BN and increase the amount of solid solution B, whereby hardenability can be further increased. Furthermore, the steel wire rod or steel bar of the present invention can be molded to, for example, a gear, by cold forging, and then when carburized, quenched and tempered and used, solid solution B is segregated in particle boundary after carburizing, quenching and tempering, thereby increasing the grain boundary strength, and it is possible to manufacture parts excellent in low-cycle fatigue strength.

Next, the reasons for specifying the structure and hardness applied to the present invention will be described.

The present inventors have intensively studied for a means of improving ductility of a steel wire rod for cold forging, and revealed that, in order to prevent forging crack, it is important that the structure after spheroidizing annealing is uniform and fine. Moreover, in order to achieve that, it was found to be effective that the ferrite fraction was suppressed to the specific amount or less, for the structure before spheroidizing annealing of the steel wire rod, and the balance was a mixed structure of one or two or more of fine martensite, bainite and pearlite.

The present invention is a steel wire rod or steel bar as hot-rolled, wherein a depth of d (mm) from the surface of the surface layer region with 20 HV 0.2 or more higher, relative to HV 0.2 that is the average hardness in the region where the depth from the surface is from sectional radius R×0.5 (mm) to the center satisfies the following formula (1). Also, the steel structure of the surface layer region comprises a ferrite fraction of 10% or less, with the balance being one or two or more of martensite, bainite and pearlite. Moreover, the steel structure where the depth from the surface is from the sectional radius R×0.5 (mm) to the center is ferrite-pearlite or ferrite-bainite.

$$0.5 \geq d/R \geq 0.03 \quad (1)$$

Here, d is a depth (mm) from the surface of the surface layer region with 20 HV 0.2 or more higher, relative to HV 0.2 that is the average hardness in the region where the depth from the surface is from sectional radius R×0.5 (mm) to the center. R is a sectional radius of a steel wire rod or steel bar.

The reasons for specifying the hardness distribution and structure distribution will be described.

In a case where a cylindrical member is upset, it is dynamically prone to cracking more on the surface, but the present inventors have experimentally investigated at what depth from the surface should be uniform and fine structure that is hardly cracked. As a result, when a depth of d from the surface of the surface layer region with 20 HV 0.2 or more higher, relative to HV 0.2 that is the average hardness in the region where the depth from the surface is from sectional radius R×0.5 (mm) to the center is less than 0.03R, cracking occurs from the vicinity of depth d, and critical cracking characteristics deteriorate, thus it was set as d≥0.03 R. With d exceeding 0.5 R, deformation resistance markedly increases, causing a reduction in mold life, thus it was set as d≤0.5 R.

The reason why the ferrite fraction of the surface layer region is set to 10% or less by area ratio is as follows. When the ferrite fraction of the structure (pre-structure) before spheroidizing annealing is high, dispersion of cementite after spheroidizing annealing concentrates on the portion other than ferrite portion in the pre-structure. As a result, distribution of cementite after spheroidizing annealing becomes nonuniform, and critical cracking characteristics deteriorate. This phenomenon becomes remarkable with a ferrite fraction exceeding 10% by area ratio, thus the fraction is limited to 10% or less, and is preferably 5% or less and more preferably 3% or less. A structure of the balance other than the ferrite is one or two or more of the martensite, bainite, and pearlite.

In the steel structure where the depth from the surface is from sectional radius R×0.5 (mm) to the center, ferrite-pearlite or ferrite-bainite are used, and as long as satisfying the above hardness distribution, the structure fraction is not particularly limited.

In order to have the hardness distribution and structure distribution described above, by pouring water to the surface of the steel material immediately after the finish rolling, the water pouring is stopped after once cooling the surface temperature of the steel material to 100 to 600° C., and the surface temperature of the steel material is recuperated to 200 to 700° C. with internal potential heat. Thus, it is possible to suppress ferrite transformation of the surface layer, and set the ferrite fraction to 10% or less, with the balance as a mixed structure of one or two or more of martensite, bainite and pearlite. In the present invention, a steel wire rod or steel bar that is hot rolled and then cooled by pouring water to the surface of the steel material is referred to as a "steel wire rod or bar as hot-rolled".

On the other hand, as the steel structure where the depth from the surface is from the sectional radius R×0.5 (mm) to the center, an effect of pouring water to the surface of the steel material is small, thus ferrite is produced and forms ferrite-pearlite or ferrite-bainite.

Next, the reason for specifying the surface roughness will be described.

After subjecting a steel wire rod or steel bar as hot-rolled to spheroidizing annealing, critical cracking characteristics in a case where upsetting is performed by a test piece cut in the longitudinal direction are affected by the surface roughness of the basis material. Here, in the steel wire rod or steel bar as hot-rolled, the surface of the basis material is in a state of being covered by scales. In a case where the surface roughness is simply measured, the surface roughness of the scales that cover the basis material is measured, and the surface roughness of the basis material affecting the critical cracking characteristics cannot be known. Therefore, the scales adhered to the surface are removed, and the surface roughness in the circumferential direction is measured, whereby it is possible to measure the surface roughness of the basis material affecting the critical cracking characteristics. As a result of investigating the surface roughness and critical cracking characteristics after removing scales from a rolled material rolled in various conditions to greatly change the surface roughness, the critical cracking characteristics degrade as the surface roughness is high, but when the surface roughness is reduced to Ra≤4 μm, the critical cracking characteristics do not degrade, thus it was specified as Ra≤4 μm. Ra was calculated according to the Ra defined in JIS B0601: '82.

Here, scales can be removed by pickling, shot blasting and the like. Pickling is carried out, for example, in the treatment conditions in a hydrochloric acid solution with a concentration of 10% by mass at 60° C. for an immersion time of 3 to 14 minutes (preferably 4 to 12 minutes, more preferably 5 to 10 minutes). Other than the hydrochloric acid, sulfuric acid may be used. Shot blasting is carried out, for example, by projecting a steel ball with a diameter of 0.5 mm and a hardness of 47.3 HRC at a projection density of 90 Kg/m3 and a projection velocity of 70 m/s.

In order to have a surface roughness Ra in the circumferential direction when pickling the steel wire rod or steel bar of 4 μm or less, it is necessary to appropriately carry out descaling before rough rolling, after extracting the billet from the heating furnace, and also to keep the surface temperature of the steel material during passing the rolled material from rough rolling to finish rolling high at a constant temperature or more. It is achieved by having a minimum temperature of the surface temperature of the steel material during passing the rolled material of 860° C. or more, preferably 900° C. or more, and further preferably 910° C. or more. When the surface temperature of the steel material during passing the rolled material is low, deformability deteriorates to form fine wrinkle-like deformation, thus the surface roughness increases. After extracting the billet from the heating furnace, the descaling before hot rolling or during rolling is usually carried out by high water pressure, and in order to appropriately carry out descaling, it is necessary to set the descaling water pressure high. However, at a high descaling water pressure, the surface temperature of the steel material during passing the rolled material is lowered, thus, in order to secure the minimum temperature, billet heating temperature and descaling water pressure need to be appropriately properly set.

EXAMPLES

Hereinafter, the present invention will be specifically described in detail based on examples. These examples are provided to describe the present invention, and do not limit the scope of the present invention.

162 mm square billets having the chemical compositions shown in Table 1 and Table 2 were rolled in the conditions of Table 3 and Table 4. As for all examples except for test No. 17, test pieces were collected from steel bars after being rolled, and microstructure and hardness distribution, and surface roughness after pickling were investigated. As for test No. 17, after being rolled, the outer periphery was lathe turned by one side of 0.5 mm to form a ϕ44 steel bar, further a test piece was collected from the steel bar, and microstructure and hardness distribution, and surface roughness were investigated.

Next, the steel bars once cooled to room temperature after being rolled (for test No. 17, after being cut) were heated and retained in the range of $Ac_1$+5° C. to $Ac_3$−5° C. for 20 minutes, and subjected to spheroidizing annealing heat treatment of cooling the steel bars to $Ac_1$−70° C. at a cooling rate of 5.5° C./hr or less. Then, an upsetting test was performed with a compression test piece cut perpendicular to the rolling direction of the steel bar so as to be a height of 1.5 times of the rolling diameter in the longitudinal direction to investigate the critical compression ratio. The results are collectively shown in Tables 3 and 4.

[Hardness Distribution, Microstructure]

For a steel bar in which section (C section) cut perpendicular to the rolling direction of the steel bar was embedded with resin, the hardness distribution was examined in 100 μm pitch using micro Vickers in the condition of a test force of 1.961 N, and the region with 20 HV 0.2 or more higher, relative to HV 0.2 that is the average hardness in the region where the depth from the surface is from sectional radius R×0.5 (mm) to the center was defined as a depth of d mm from the surface.

Next, under an optical microscope, the surface layer part was observed at a total of eight points at a 200 μm depth from the surface layer and a d mm depth from the surface layer in the four directions different by 90 degrees on the C section of the wire rod, at a magnification of 1000 times, and the ferrite fraction was measured. In the range from the surface layer to d mm, the balance of the ferrite was one or two or more of the martensite, bainite and pearlite.

[Surface Roughness]

In a case of pickling, the steel bar was pickled by being immersed in a hydrochloric acid solution with a concentration of 10% by mass at a temperature of 60° C. for 5 to 10 minutes, and after visually confirming that scale was removed from the entire circumference, roughness in the circumferential direction was measured, and Ra as defined in JIS B0601: '82 was calculated.

[Critical Compression Test]

The compression ratio (%) to have a failure probability of 50% from the upsetting test in the conditions to have a strain rate of 10 s-1 was investigated. Cracking was defined as cracking with a crack length of 0.5 mm or more, observed visually, or under an optical microscopy as necessary. Due to pressure on the mold surface, the upper limit of the compression ratio was set to 80%. When cracking did not occur at 80%, the critical compression ratio was defined to be 80%.

As is apparent from Table 3 and Table 4, it can be seen that the critical compression ratios of inventive examples (test Nos. 1 to 27, 37 to 78) are remarkably excellent as compared to the critical compression ratios of comparative examples (test Nos. 28 to 36).

In test Nos. 28, 31 and 32 of comparative examples, since the range of d was outside of the specification, and the surface layer structure before spheroidizing annealing was not good, the cementite after spheroidizing annealing was not sufficiently uniformly dispersed, and thus the critical compression ratio was reduced. It was caused by insufficient cooling due to lack of water amount during cooling in Nos. 28 and 31, and rapid material passing rate in water-cooling band in No. 32.

In comparative examples Nos. 29 and 30, since the rolling temperature was low, deformability during rolling deteriorated, thus the surface roughness deteriorated, and the critical limit compression ratio was reduced.

In comparative examples Nos. 33 and 34, the chemical composition of P or S that lowers the cold workability exceeded the specification of the present application, and working limit was consequently lowered.

In comparative example No. 35, after extracting the billet from the heating furnace, the descaling water pressure before hot rolling was too low, thus descaling was not sufficiently performed. Therefore, the surface roughness exceeded the specification of the present application, and the working limit was consequently lowered.

In comparative example No. 36, after extracting the billet from the heating furnace, the descaling water pressure before hot rolling was too high, thus the minimum temperature on the surface of the steel material during passing of the rolled material was low, and the billet was outside of the specification of the present application. Therefore, deformability during rolling deteriorated, thus the surface roughness deteriorated, and the working limit was lowered.

Furthermore, for Examples 37 to 78, carburizing, quenching and tempering (quenching was performed after gas carburizing in the conditions of 950° C.×300 minutes and a carbon potential of 0.8, then tempering at 150° C.×90 minutes was performed.) were performed after spheroidizing annealing.

[Surface Fatigue Strength]

A small roller (with a cylindrical surface with a diameter of 26 mm×width of 18 mm) for a roller pitting test was prepared, and a roller pitting fatigue test was conducted in the conditions of a Hertz stress of 3000 MPa, a slip ratio of −40%, and an ATF oil temperature of 80° C. The number of repetitions until pitting occurred was listed in Table 4. In a case where pitting did not occur, the roller pitting fatigue test was repeated until 10,000,000 times.

[Low-Cycle Fatigue Strength]

A four-point bending fatigue test piece (13 mm×80 mm L, 3 mm V notch in the central part) was prepared, and a four-point bending low-cycle fatigue test was performed at a frequency of 1 Hz with a sine wave at a stress ratio of 0.1. In Table 4, 500 times strength was listed.

The surface fatigue strength is high in Examples 37 to 76 satisfying the formula (2), as compared to Examples 77 and 78.

It can be seen that Examples 57 to 78 containing Ti: 0.02 to 0.20% and B: 0.0005 to 0.0035% are excellent in low cycle fatigue as compared to Examples 37 to 56 not containing Ti and B.

TABLE 1

| Test | | Chemical composition(mass %) | | | | | | | | | |
|---|---|---|---|---|---|---|---|---|---|---|---|
| No. | Category | C | Si | Mn | P | S | Al | N | Cr | Mo | Other |
| 1 | Inventive Example | 0.53 | 0.24 | 0.68 | 0.016 | 0.005 | 0.025 | 0.0051 | 0.14 | — | |
| 2 | Inventive Example | 0.45 | 0.15 | 0.45 | 0.006 | 0.004 | 0.022 | 0.0064 | 0.13 | — | |
| 3 | Inventive Example | 0.38 | 0.22 | 0.55 | 0.004 | 0.007 | 0.021 | 0.0067 | — | 0.05 | |
| 4 | Inventive Example | 0.52 | 0.18 | 0.53 | 0.009 | 0.005 | 0.019 | 0.0065 | 0.17 | — | |
| 5 | Inventive Example | 0.54 | 0.25 | 0.75 | 0.010 | 0.005 | 0.016 | 0.0041 | 0.15 | — | Ca: 0.0010 |
| 6 | Inventive Example | 0.53 | 0.26 | 0.65 | 0.010 | 0.004 | 0.015 | 0.0051 | 0.16 | — | |
| 7 | Inventive Example | 0.54 | 0.14 | 0.58 | 0.012 | 0.005 | 0.025 | 0.0052 | 0.15 | — | Ti: 0.02 |
| 8 | Inventive Example | 0.55 | 0.33 | 0.49 | 0.009 | 0.005 | 0.025 | 0.0075 | 0.15 | — | Sb: 0.0007 |
| 9 | Inventive Example | 0.48 | 0.22 | 0.57 | 0.008 | 0.005 | 0.024 | 0.0060 | 0.11 | — | |
| 10 | Inventive Example | 0.56 | 0.21 | 0.63 | 0.014 | 0.003 | 0.025 | 0.0051 | 0.12 | 0.10 | |
| 11 | Inventive Example | 0.53 | 0.18 | 0.74 | 0.017 | 0.005 | 0.025 | 0.0049 | — | — | |
| 12 | Inventive Example | 0.57 | 0.16 | 0.75 | 0.016 | 0.005 | 0.025 | 0.0055 | 0.15 | — | |
| 13 | Inventive Example | 0.50 | 0.15 | 0.79 | 0.015 | 0.005 | 0.026 | 0.0051 | 0.11 | — | |
| 14 | Inventive Example | 0.58 | 0.14 | 0.81 | 0.017 | 0.012 | 0.025 | 0.0051 | 0.12 | — | |
| 15 | Inventive Example | 0.51 | 0.25 | 0.39 | 0.018 | 0.015 | 0.025 | 0.0064 | 0.13 | — | |
| 16 | Inventive Example | 0.54 | 0.28 | 0.65 | 0.018 | 0.007 | 0.071 | 0.0048 | 0.11 | — | |
| 17 | Inventive Example | 0.59 | 0.24 | 0.57 | 0.017 | 0.005 | 0.101 | 0.0046 | 0.22 | — | |
| 18 | Inventive Example | 0.57 | 0.19 | 0.78 | 0.018 | 0.004 | 0.026 | 0.0049 | 0.17 | — | Cu: 0.3, Ni: 0.6 |
| 19 | Inventive Example | 0.56 | 0.18 | 0.74 | 0.010 | 0.007 | 0.026 | 0.0051 | 0.16 | — | B: 0.0025, Ti: 0.03 |
| 20 | Inventive Example | 0.55 | 0.19 | 0.53 | 0.014 | 0.005 | 0.021 | 0.0052 | 0.15 | — | Zr: 0.0005, REM: 0.0004 |
| 21 | Inventive Example | 0.59 | 0.14 | 0.75 | 0.012 | 0.006 | 0.026 | 0.0055 | 0.17 | — | Mg: 0.0005 |
| 22 | Inventive Example | 0.54 | 0.25 | 0.64 | 0.013 | 0.004 | 0.023 | 0.0051 | 0.17 | — | Nb: 0.03 |
| 23 | Inventive Example | 0.53 | 0.27 | 0.58 | 0.013 | 0.005 | 0.026 | 0.0048 | 0.18 | — | V: 0.09 |
| 24 | Inventive Example | 0.58 | 0.24 | 0.52 | 0.010 | 0.006 | 0.027 | 0.0066 | 0.15 | — | W: 0.03 |
| 25 | Inventive Example | 0.57 | 0.21 | 0.57 | 0.017 | 0.005 | 0.026 | 0.0048 | — | — | Te: 0.0008 |
| 26 | Inventive Example | 0.54 | 0.22 | 0.63 | 0.012 | 0.004 | 0.029 | 0.0049 | — | — | Bi: 0.02 |
| 27 | Inventive Example | 0.54 | 0.28 | 0.77 | 0.015 | 0.003 | 0.026 | 0.0043 | — | — | Pb: 0.03 |
| 28 | Comparative Example | 0.54 | 0.28 | 0.65 | 0.015 | 0.006 | 0.079 | 0.0051 | 0.15 | — | |
| 29 | Comparative Example | 0.53 | 0.24 | 0.57 | 0.010 | 0.005 | 0.102 | 0.0053 | — | — | |
| 30 | Comparative Example | 0.54 | 0.18 | 0.49 | 0.011 | 0.002 | 0.154 | 0.0068 | 0.16 | — | |
| 31 | Comparative Example | 0.52 | 0.19 | 0.57 | 0.008 | 0.003 | 0.022 | 0.0054 | 0.11 | — | |
| 32 | Comparative Example | 0.51 | 0.22 | 0.55 | 0.009 | 0.004 | 0.019 | 0.0047 | 0.12 | — | |
| 33 | Comparative Example | 0.48 | 0.31 | 0.75 | 0.045 | 0.005 | 0.018 | 0.0056 | — | — | |
| 34 | Comparative Example | 0.49 | 0.18 | 0.74 | 0.018 | 0.051 | 0.201 | 0.0063 | 0.34 | — | |
| 35 | Comparative Example | 0.53 | 0.21 | 0.58 | 0.009 | 0.003 | 0.021 | 0.0050 | 0.12 | — | |
| 36 | Comparative Example | 0.54 | 0.22 | 0.55 | 0.006 | 0.003 | 0.024 | 0.0048 | 0.12 | — | |

TABLE 2

| Test | | Chemical composition (mass %) | | | | | | | | | | | | | |
|---|---|---|---|---|---|---|---|---|---|---|---|---|---|---|---|
| No. | Category | C | Si | Mn | P | S | Al | N | Cr | Mo | Cu | Ni | B | Ca | Zr |
| 37 | Inventive Example | 0.21 | 1.5 | 0.75 | 0.014 | 0.014 | 0.024 | 0.012 | — | — | — | — | — | — | — |
| 38 | Inventive Example | 0.21 | 0.5 | 0.42 | 0.014 | 0.014 | 0.024 | 0.012 | 1.45 | — | — | — | — | — | — |
| 39 | Inventive Example | 0.21 | 0.5 | 0.42 | 0.014 | 0.014 | 0.024 | 0.012 | 1.45 | 0.16 | — | — | — | — | — |
| 40 | Inventive Example | 0.21 | 0.7 | 0.42 | 0.014 | 0.014 | 0.024 | 0.012 | — | 1.20 | — | — | — | — | — |
| 41 | Inventive Example | 0.21 | 1.5 | 0.75 | 0.014 | 0.014 | 0.024 | 0.012 | — | — | 0.3 | 0.6 | — | — | — |
| 42 | Inventive Example | 0.21 | 1.5 | 0.75 | 0.014 | 0.014 | 0.024 | 0.012 | — | — | — | — | 0.0006 | — | — |
| 43 | Inventive Example | 0.21 | 1.5 | 0.75 | 0.014 | 0.014 | 0.024 | 0.012 | — | — | — | — | — | 0.001 | — |
| 44 | Inventive Example | 0.21 | 1.5 | 0.75 | 0.014 | 0.014 | 0.024 | 0.012 | — | — | — | — | — | — | 0.001 |
| 45 | Inventive Example | 0.21 | 1.5 | 0.75 | 0.014 | 0.014 | 0.024 | 0.012 | — | — | — | — | — | — | 0.0005 |
| 46 | Inventive Example | 0.21 | 1.5 | 0.75 | 0.014 | 0.014 | 0.024 | 0.012 | — | — | — | — | — | — | — |
| 47 | Inventive Example | 0.21 | 1.5 | 0.75 | 0.014 | 0.014 | 0.024 | 0.012 | — | — | — | — | — | — | — |
| 48 | Inventive Example | 0.21 | 1.5 | 0.75 | 0.014 | 0.014 | 0.024 | 0.012 | — | — | — | — | — | — | — |
| 49 | Inventive Example | 0.21 | 1.1 | 0.50 | 0.014 | 0.014 | 0.024 | 0.012 | — | — | — | — | — | — | — |
| 50 | Inventive Example | 0.21 | 1.5 | 0.75 | 0.014 | 0.014 | 0.024 | 0.012 | — | — | — | — | — | — | — |
| 51 | Inventive Example | 0.21 | 1.5 | 0.75 | 0.014 | 0.014 | 0.024 | 0.012 | — | — | — | — | — | — | — |
| 52 | Inventive Example | 0.21 | 1.5 | 0.75 | 0.014 | 0.014 | 0.024 | 0.012 | — | — | — | — | — | — | — |
| 53 | Inventive Example | 0.21 | 1.5 | 0.75 | 0.014 | 0.014 | 0.024 | 0.012 | — | — | — | — | — | — | — |
| 54 | Inventive Example | 0.21 | 1.5 | 0.75 | 0.014 | 0.014 | 0.024 | 0.012 | — | — | — | — | — | — | — |
| 55 | Inventive Example | 0.21 | 1.5 | 0.75 | 0.014 | 0.014 | 0.024 | 0.012 | — | — | — | — | — | — | — |
| 56 | Inventive Example | 0.21 | 1.5 | 0.75 | 0.014 | 0.014 | 0.024 | 0.012 | — | — | — | — | — | — | — |
| 57 | Inventive Example | 0.21 | 0.7 | 0.42 | 0.014 | 0.014 | 0.024 | 0.012 | — | — | — | — | 0.0025 | — | — |

TABLE 2-continued

| | | | | | | | | | | | | | | | |
|---|---|---|---|---|---|---|---|---|---|---|---|---|---|---|---|
| 58 | Inventive Example | 0.21 | 0.5 | 0.42 | 0.014 | 0.014 | 0.024 | 0.012 | 1.45 | — | — | — | 0.0025 | — | — |
| 59 | Inventive Example | 0.21 | 0.5 | 0.42 | 0.014 | 0.014 | 0.024 | 0.012 | 1.45 | 0.16 | — | — | 0.0025 | — | — |
| 60 | Inventive Example | 0.21 | 0.7 | 0.42 | 0.014 | 0.014 | 0.024 | 0.012 | — | 1.20 | — | — | 0.0025 | — | — |
| 61 | Inventive Example | 0.21 | 1.5 | 0.75 | 0.014 | 0.014 | 0.024 | 0.012 | — | — | 0.3 | 0.6 | 0.0025 | — | — |
| 62 | Inventive Example | 0.21 | 1.5 | 0.75 | 0.014 | 0.014 | 0.024 | 0.012 | — | — | — | — | 0.0025 | 0.001 | — |
| 63 | Inventive Example | 0.21 | 1.5 | 0.75 | 0.014 | 0.014 | 0.024 | 0.012 | — | — | — | — | 0.0025 | — | 0.001 |
| 64 | Inventive Example | 0.21 | 1.5 | 0.75 | 0.014 | 0.014 | 0.024 | 0.012 | — | — | — | — | 0.0025 | — | 0.0005 |
| 65 | Inventive Example | 0.21 | 1.5 | 0.75 | 0.014 | 0.014 | 0.024 | 0.012 | — | — | — | — | 0.0025 | — | — |
| 66 | Inventive Example | 0.21 | 1.5 | 0.75 | 0.014 | 0.014 | 0.024 | 0.012 | — | — | — | — | 0.0025 | — | — |
| 67 | Inventive Example | 0.21 | 1.5 | 0.75 | 0.014 | 0.014 | 0.024 | 0.012 | — | — | — | — | 0.0025 | — | — |
| 68 | Inventive Example | 0.21 | 1.1 | 0.50 | 0.014 | 0.014 | 0.024 | 0.012 | — | — | — | — | 0.0025 | — | — |
| 69 | Inventive Example | 0.21 | 1.5 | 0.75 | 0.014 | 0.014 | 0.024 | 0.012 | — | — | — | — | 0.0025 | — | — |
| 70 | Inventive Example | 0.21 | 1.5 | 0.75 | 0.014 | 0.014 | 0.024 | 0.012 | — | — | — | — | 0.0025 | — | — |
| 71 | Inventive Example | 0.21 | 1.5 | 0.75 | 0.014 | 0.014 | 0.024 | 0.012 | — | — | — | — | 0.0025 | — | — |
| 72 | Inventive Example | 0.21 | 1.5 | 0.75 | 0.014 | 0.014 | 0.024 | 0.012 | — | — | — | — | 0.0025 | — | — |
| 73 | Inventive Example | 0.21 | 1.5 | 0.75 | 0.014 | 0.014 | 0.024 | 0.012 | — | — | — | — | 0.0025 | — | — |
| 74 | Inventive Example | 0.21 | 1.5 | 0.75 | 0.014 | 0.014 | 0.024 | 0.012 | — | — | — | — | 0.0025 | — | — |
| 75 | Inventive Example | 0.21 | 1.5 | 0.75 | 0.014 | 0.014 | 0.024 | 0.012 | — | — | — | — | 0.0025 | — | — |
| 76 | Inventive Example | 0.21 | 0.3 | 0.52 | 0.014 | 0.01 | 0.03 | 0.0045 | 1.45 | — | — | — | 0.0025 | — | 0.0005 |
| 77 | Inventive Example | 0.21 | 0.27 | 0.5 | 0.014 | 0.01 | 0.03 | 0.0045 | 1.40 | — | — | — | 0.002 | — | — |
| 78 | Inventive Example | 0.21 | 0.27 | 0.5 | 0.014 | 0.01 | 0.03 | 0.0045 | 1.40 | — | — | — | 0.002 | — | — |

| Test | Chemical composition(mass %) | | | | | | | | | | | | Value of |
|---|---|---|---|---|---|---|---|---|---|---|---|---|---|
| No. | Mg | REM | Ti | Nb | V | W | Sb | Sn | Zn | Te | Bi | Pb | formula (2) |
| 37 | — | — | — | — | — | — | — | — | — | — | — | — | 58 |
| 38 | — | — | — | — | — | — | — | — | — | — | — | — | 55 |
| 39 | — | — | — | — | — | — | — | — | — | — | — | — | 59 |
| 40 | — | — | — | — | — | — | — | — | — | — | — | — | 59 |
| 41 | — | — | — | — | — | — | — | — | — | — | — | — | 58 |
| 42 | — | — | — | — | — | — | — | — | — | — | — | — | 58 |
| 43 | — | — | — | — | — | — | — | — | — | — | — | — | 58 |
| 44 | — | — | — | — | — | — | — | — | — | — | — | — | 58 |
| 45 | — | 0.0004 | — | — | — | — | — | — | — | — | — | — | 58 |
| 46 | 0.0005 | — | — | — | — | — | — | — | — | — | — | — | 58 |
| 47 | — | — | 0.02 | — | — | — | — | — | — | — | — | — | 58 |
| 48 | — | — | — | 0.03 | — | — | — | — | — | — | — | — | 58 |
| 49 | — | — | — | — | 0.09 | — | — | — | — | — | — | — | 51 |
| 50 | — | — | — | — | — | 0.03 | — | — | — | — | — | — | 58 |
| 51 | — | — | — | — | — | — | 0.0007 | — | — | — | — | — | 58 |
| 52 | — | — | — | — | — | — | — | 0.03 | — | — | — | — | 58 |
| 53 | — | — | — | — | — | — | — | — | 0.03 | — | — | — | 58 |
| 54 | — | — | — | — | — | — | — | — | — | 0.0008 | — | — | 58 |
| 55 | — | — | — | — | — | — | — | — | — | — | 0.02 | — | 58 |
| 56 | — | — | — | — | — | — | — | — | — | — | — | 0.03 | 58 |
| 57 | — | — | 0.15 | — | — | — | — | — | — | — | — | — | 51 |
| 58 | — | — | 0.15 | — | — | — | — | — | — | — | — | — | 55 |
| 59 | — | — | 0.15 | — | — | — | — | — | — | — | — | — | 59 |
| 60 | — | — | 0.15 | — | — | — | — | — | — | — | — | — | 59 |
| 61 | — | — | 0.15 | — | — | — | — | — | — | — | — | — | 58 |
| 62 | — | — | 0.15 | — | — | — | — | — | — | — | — | — | 58 |
| 63 | — | — | 0.15 | — | — | — | — | — | — | — | — | — | 58 |
| 64 | — | 0.0004 | 0.15 | — | — | — | — | — | — | — | — | — | 58 |
| 65 | 0.0005 | — | 0.15 | — | — | — | — | — | — | — | — | — | 58 |
| 66 | — | — | 0.15 | — | — | — | — | — | — | — | — | — | 58 |
| 67 | — | — | 0.15 | 0.03 | — | — | — | — | — | — | — | — | 58 |
| 68 | — | — | 0.15 | — | 0.09 | — | — | — | — | — | — | — | 51 |
| 69 | — | — | 0.15 | — | — | 0.03 | — | — | — | — | — | — | 58 |
| 70 | — | — | 0.15 | — | — | — | 0.0007 | — | — | — | — | — | 58 |
| 71 | — | — | 0.15 | — | — | — | — | 0.03 | — | — | — | — | 58 |
| 72 | — | — | 0.15 | — | — | — | — | — | 0.03 | — | — | — | 58 |
| 73 | — | — | 0.15 | — | — | — | — | — | — | 0.0008 | — | — | 58 |
| 74 | — | — | 0.15 | — | — | — | — | — | — | — | 0.02 | — | 58 |
| 75 | — | — | 0.15 | — | — | — | — | — | — | — | — | 0.03 | 58 |
| 76 | — | 0.0004 | 0.15 | — | — | — | — | — | — | — | — | 0.03 | 50 |
| 77 | — | — | 0.03 | — | — | — | — | — | — | — | — | — | 48 |
| 78 | — | — | 0.15 | — | — | — | — | — | — | — | — | — | 48 |

TABLE 3

| Test No. | Category | Minimum temperature on surface of steel material from rolling heating to before cooling by pouring water ° C. | Descaling pressure Mpa | Material passing rate in water-cooling band m/sec | Amount of water poured immediately after finish rolling $m^3$/hr | Surface temperature of steel material Minimum temperature ° C. | Surface temperature of steel material Recuperation temperature ° C. | Steel bar diameter mm |
|---|---|---|---|---|---|---|---|---|
| 1 | Inventive Example | 910 | 13 | 12 | 710 | 530 | 620 | 45 |
| 2 | Inventive Example | 901 | 13 | 12 | 720 | 348 | 428 | 26 |
| 3 | Inventive Example | 930 | 13 | 12 | 750 | 511 | 610 | 55 |
| 4 | Inventive Example | 904 | 13 | 12 | 730 | 358 | 452 | 30 |
| 5 | Inventive Example | 916 | 13 | 12 | 780 | 476 | 586 | 45 |
| 6 | Inventive Example | 902 | 13 | 12 | 850 | 502 | 610 | 45 |
| 7 | Inventive Example | 918 | 13 | 12 | 880 | 502 | 605 | 45 |
| 8 | Inventive Example | 930 | 13 | 12 | 760 | 513 | 622 | 45 |
| 9 | Inventive Example | 901 | 13 | 12 | 724 | 480 | 579 | 45 |
| 10 | Inventive Example | 911 | 13 | 12 | 850 | 478 | 570 | 45 |
| 11 | Inventive Example | 945 | 13 | 12 | 860 | 512 | 610 | 45 |
| 12 | Inventive Example | 921 | 13 | 12 | 770 | 409 | 512 | 45 |
| 13 | Inventive Example | 918 | 13 | 12 | 750 | 502 | 612 | 45 |
| 14 | Inventive Example | 910 | 13 | 12 | 810 | 504 | 600 | 45 |
| 15 | Inventive Example | 906 | 13 | 12 | 780 | 480 | 590 | 45 |
| 16 | Inventive Example | 902 | 13 | 12 | 790 | 521 | 630 | 45 |
| 17 | Inventive Example | 903 | 13 | 12 | 770 | 503 | 610 | 44 |
| 18 | Inventive Example | 901 | 13 | 12 | 780 | 502 | 601 | 45 |
| 19 | Inventive Example | 901 | 13 | 12 | 790 | 505 | 605 | 45 |
| 20 | Inventive Example | 902 | 13 | 12 | 770 | 533 | 630 | 45 |
| 21 | Inventive Example | 912 | 13 | 12 | 770 | 530 | 628 | 45 |
| 22 | Inventive Example | 912 | 13 | 12 | 760 | 522 | 622 | 45 |
| 23 | Inventive Example | 911 | 13 | 12 | 780 | 511 | 604 | 45 |
| 24 | Inventive Example | 903 | 13 | 12 | 777 | 522 | 618 | 45 |
| 25 | Inventive Example | 907 | 13 | 12 | 790 | 503 | 600 | 45 |
| 26 | Inventive Example | 904 | 13 | 12 | 740 | 512 | 609 | 45 |
| 27 | Inventive Example | 902 | 13 | 12 | 750 | 513 | 610 | 45 |
| 28 | Comparative Example | 980 | 13 | 12 | 600 | 584 | 670 | 45 |
| 29 | Comparative Example | 850 | 13 | 12 | 740 | 486 | 561 | 45 |
| 30 | Comparative Example | 800 | 13 | 12 | 850 | 479 | 551 | 45 |
| 31 | Comparative Example | 903 | 13 | 12 | 480 | 680 | 710 | 45 |
| 32 | Comparative Example | 904 | 13 | 20 | 710 | 691 | 720 | 45 |
| 33 | Comparative Example | 905 | 13 | 12 | 820 | 487 | 580 | 45 |
| 34 | Comparative Example | 901 | 13 | 12 | 790 | 488 | 585 | 45 |
| 35 | Comparative Example | 900 | 6 | 12 | 780 | 480 | 570 | 45 |
| 36 | Comparative Example | 845 | 18 | 12 | 770 | 460 | 550 | 45 |

| Test No. | Depth d mm | d/R | Ferrite fraction to depth d % | Structure to depth d | Surface roughness Ra μm | Critical compression ratio % | Repeat count Times | 500 times strength kN | Value of formula (2) |
|---|---|---|---|---|---|---|---|---|---|
| 1 | 2.10 | 0.05 | 1 | Martensite + bainite | 3.2 | 80 | — | — | — |
| 2 | 4.90 | 0.19 | 0 | Martensite | 3.1 | 80 | — | — | — |
| 3 | 2.60 | 0.05 | 1 | Martensite + bainite | 3.3 | 80 | — | — | — |
| 4 | 3.20 | 0.11 | 0 | Martensite | 3.4 | 80 | — | — | — |
| 5 | 3.10 | 0.07 | 2 | Martensite + bainite | 3.3 | 80 | — | — | — |
| 6 | 2.50 | 0.06 | 1 | Martensite + bainite | 3.2 | 80 | — | — | — |
| 7 | 2.80 | 0.06 | 2 | Martensite + bainite | 3 | 80 | — | — | — |
| 8 | 1.90 | 0.04 | 2 | Martensite + bainite | 3.2 | 80 | — | — | — |
| 9 | 3.20 | 0.07 | 1 | Martensite + bainite | 3.2 | 80 | — | — | — |
| 10 | 4.10 | 0.09 | 0 | Martensite + bainite | 3.3 | 80 | — | — | — |
| 11 | 2.50 | 0.06 | 0 | Martensite + bainite | 3.3 | 80 | — | — | — |
| 12 | 3.20 | 0.07 | 0 | Martensite + bainite | 3.3 | 80 | — | — | — |
| 13 | 3.10 | 0.07 | 0 | Martensite + bainite | 3.4 | 80 | — | — | — |
| 14 | 3.20 | 0.07 | 0 | Martensite + bainite | 3.5 | 80 | — | — | — |
| 15 | 3.30 | 0.07 | 2 | Martensite + bainite | 3.2 | 80 | — | — | — |
| 16 | 2.90 | 0.06 | 1 | Martensite + bainite | 2.9 | 80 | — | — | — |
| 17 | 2.60 | 0.06 | 0 | Martensite + bainite | 0.51 | 80 | — | — | — |
| 18 | 2.87 | 0.06 | 0 | Martensite + bainite | 2.7 | 80 | — | — | — |
| 19 | 2.90 | 0.06 | 0 | Martensite + bainite | 2.8 | 80 | — | — | — |
| 20 | 2.88 | 0.06 | 0 | Martensite + bainite | 3.2 | 80 | — | — | — |
| 21 | 2.85 | 0.06 | 0 | Martensite + bainite | 3.2 | 80 | — | — | — |
| 22 | 2.70 | 0.06 | 0 | Martensite + bainite | 2.8 | 80 | — | — | — |
| 23 | 3.24 | 0.07 | 0 | Martensite + bainite | 3.2 | 80 | — | — | — |
| 24 | 3.10 | 0.07 | 0 | Martensite + bainite | 2.9 | 80 | — | — | — |
| 25 | 3.22 | 0.07 | 0 | Martensite + bainite | 3.2 | 80 | — | — | — |
| 26 | 2.62 | 0.06 | 1 | Martensite + bainite | 3.2 | 80 | — | — | — |
| 27 | 2.50 | 0.06 | 0 | Martensite + bainite | 3.1 | 80 | — | — | — |

TABLE 3-continued

| | | | | | | | | | |
|---|---|---|---|---|---|---|---|---|---|
| 28 | 1.00 | 0.02 | 1 | Martensite + bainite | 3.2 | 65 | — | — | — |
| 29 | 2.20 | 0.05 | 0 | Martensite + bainite | 4.8 | 63 | — | — | — |
| 30 | 3.60 | 0.08 | 0 | Martensite + bainite | 4.9 | 60 | — | — | — |
| 31 | 0.00 | 0.00 | 15 | Bainite + pearlite | 3.1 | 72 | — | — | — |
| 32 | 0.00 | 0.00 | 20 | Bainite + pearlite | 3.2 | 69 | — | — | — |
| 33 | 3.40 | 0.08 | 2 | Bainite + pearlite | 3.2 | 70 | — | — | — |
| 34 | 3.30 | 0.07 | 3 | Bainite + pearlite | 3.2 | 65 | — | — | — |
| 35 | 3.40 | 0.08 | 0 | Martensite + bainite | 4.8 | 65 | — | — | — |
| 36 | 3.80 | 0.08 | 0 | Martensite + bainite | 4.7 | 65 | — | — | — |

TABLE 4

| Test No. | Category | Minimum temperature on surface of steel material from rolling heating to before cooling by pouring water ° C. | Descaling pressure Mpa | Material passing rate in water-cooling band m/sec | Amount of water poured immediately after finish rolling $m^3$/hour | Surface temperature of steel material Minimum temperature ° C. | Surface temperature of steel material Recuperation temperature ° C. | Steel bar diameter mm |
|---|---|---|---|---|---|---|---|---|
| 37 | Inventive Example | 910 | 13 | 12 | 710 | 530 | 620 | 45 |
| 38 | Inventive Example | 910 | 13 | 12 | 710 | 530 | 624 | 45 |
| 39 | Inventive Example | 912 | 13 | 12 | 710 | 521 | 630 | 45 |
| 40 | Inventive Example | 913 | 13 | 12 | 710 | 501 | 610 | 45 |
| 41 | Inventive Example | 910 | 13 | 12 | 710 | 520 | 623 | 45 |
| 42 | Inventive Example | 910 | 13 | 12 | 710 | 540 | 620 | 45 |
| 43 | Inventive Example | 908 | 13 | 12 | 710 | 531 | 620 | 45 |
| 44 | Inventive Example | 909 | 13 | 12 | 710 | 520 | 608 | 45 |
| 45 | Inventive Example | 907 | 13 | 12 | 710 | 511 | 601 | 45 |
| 46 | Inventive Example | 906 | 13 | 12 | 710 | 521 | 607 | 45 |
| 47 | Inventive Example | 905 | 13 | 12 | 710 | 525 | 609 | 45 |
| 48 | Inventive Example | 904 | 13 | 12 | 710 | 528 | 612 | 45 |
| 49 | Inventive Example | 903 | 13 | 12 | 710 | 529 | 619 | 45 |
| 50 | Inventive Example | 910 | 13 | 12 | 710 | 521 | 611 | 45 |
| 51 | Inventive Example | 915 | 13 | 12 | 710 | 503 | 593 | 45 |
| 52 | Inventive Example | 913 | 13 | 12 | 710 | 503 | 591 | 45 |
| 53 | Inventive Example | 913 | 13 | 12 | 710 | 505 | 595 | 45 |
| 54 | Inventive Example | 910 | 13 | 12 | 710 | 534 | 624 | 45 |
| 55 | Inventive Example | 912 | 13 | 12 | 710 | 521 | 607 | 45 |
| 56 | Inventive Example | 910 | 13 | 12 | 710 | 523 | 613 | 45 |
| 57 | Inventive Example | 908 | 13 | 12 | 710 | 521 | 595 | 45 |
| 58 | Inventive Example | 908 | 13 | 12 | 710 | 522 | 605 | 45 |
| 59 | Inventive Example | 909 | 13 | 12 | 710 | 503 | 593 | 45 |
| 60 | Inventive Example | 910 | 13 | 12 | 710 | 512 | 602 | 45 |
| 61 | Inventive Example | 910 | 13 | 12 | 710 | 514 | 600 | 45 |
| 62 | Inventive Example | 910 | 13 | 12 | 710 | 523 | 613 | 45 |
| 63 | Inventive Example | 911 | 13 | 12 | 710 | 531 | 621 | 45 |
| 64 | Inventive Example | 912 | 13 | 12 | 710 | 532 | 620 | 45 |
| 65 | Inventive Example | 909 | 13 | 12 | 710 | 535 | 625 | 45 |
| 66 | Inventive Example | 907 | 13 | 12 | 710 | 528 | 614 | 45 |
| 67 | Inventive Example | 908 | 13 | 12 | 710 | 539 | 629 | 45 |
| 68 | Inventive Example | 995 | 13 | 12 | 710 | 514 | 604 | 45 |
| 69 | Inventive Example | 906 | 13 | 12 | 710 | 526 | 635 | 45 |
| 70 | Inventive Example | 906 | 13 | 12 | 710 | 535 | 617 | 45 |
| 71 | Inventive Example | 908 | 13 | 12 | 710 | 520 | 610 | 45 |
| 72 | Inventive Example | 912 | 13 | 12 | 710 | 525 | 615 | 45 |
| 73 | Inventive Example | 912 | 13 | 12 | 710 | 523 | 611 | 45 |
| 74 | Inventive Example | 914 | 13 | 12 | 710 | 524 | 609 | 45 |
| 75 | Inventive Example | 908 | 13 | 12 | 710 | 527 | 617 | 45 |
| 76 | Inventive Example | 909 | 13 | 12 | 710 | 526 | 611 | 45 |
| 77 | Inventive Example | 913 | 13 | 12 | 710 | 523 | 613 | 45 |
| 78 | Inventive Example | 912 | 13 | 12 | 710 | 533 | 623 | 45 |

| Test No. | Depth d mm | d/R | Ferrite fraction to depth d % | Structure to depth d | Surface roughness Ra μm | Critical compression ratio % | Repeat count Times | 500 times strength kN | Value of formula (2) |
|---|---|---|---|---|---|---|---|---|---|
| 37 | 5.30 | 0.11 | 1 | Martensite + bainite | 3.2 | 80 | 10,000,000 | 16 | 58 |
| 38 | 5.30 | 0.12 | 0 | Martensite + bainite | 3.2 | 80 | 10,000,000 | 15 | 55 |
| 39 | 5.30 | 0.18 | 0 | Martensite + bainite | 3.7 | 80 | 10,000,000 | 17 | 59 |
| 40 | 8.40 | 0.19 | 0 | Martensite + bainite | 3.6 | 80 | 10,000,000 | 15 | 59 |
| 41 | 5.10 | 0.11 | 0 | Martensite + bainite | 3.1 | 80 | 10,000,000 | 16 | 58 |
| 42 | 7.50 | 0.17 | 0 | Martensite + bainite | 3.2 | 80 | 10,000,000 | 19 | 58 |

TABLE 4-continued

| | | | | | | | | | |
|---|---|---|---|---|---|---|---|---|---|
| 43 | 3.90 | 0.09 | 1 | Martensite + bainite | 2.7 | 80 | 10,000,000 | 16 | 58 |
| 44 | 3.90 | 0.09 | 0 | Martensite + bainite | 2.6 | 80 | 10,000,000 | 16 | 58 |
| 45 | 3.70 | 0.08 | 1 | Martensite + bainite | 3.4 | 80 | 10,000,000 | 14 | 58 |
| 46 | 3.90 | 0.09 | 0 | Martensite + bainite | 3.2 | 80 | 10,000,000 | 15 | 58 |
| 47 | 3.90 | 0.09 | 0 | Martensite + bainite | 2.6 | 80 | 10,000,000 | 15 | 58 |
| 48 | 3.80 | 0.08 | 0 | Martensite + bainite | 2.7 | 80 | 10,000,000 | 14 | 58 |
| 49 | 3.10 | 0.07 | 0 | Martensite + bainite | 3.1 | 80 | 10,000,000 | 14 | 51 |
| 50 | 3.70 | 0.08 | 0 | Martensite + bainite | 3.3 | 80 | 10,000,000 | 14 | 58 |
| 51 | 3.80 | 0.08 | 0 | Martensite + bainite | 3.4 | 80 | 10,000,000 | 16 | 58 |
| 52 | 3.80 | 0.08 | 0 | Martensite + bainite | 3.3 | 80 | 10,000,000 | 16 | 58 |
| 53 | 3.70 | 0.08 | 0 | Martensite + bainite | 3.2 | 80 | 10,000,000 | 14 | 58 |
| 54 | 3.90 | 0.09 | 0 | Martensite + bainite | 3 | 80 | 10,000,000 | 15 | 58 |
| 55 | 3.80 | 0.08 | 0 | Martensite + bainite | 3.2 | 80 | 10,000,000 | 16 | 58 |
| 56 | 3.70 | 0.08 | 0 | Martensite + bainite | 3.2 | 80 | 10,000,000 | 16 | 58 |
| 57 | 5.2 | 0.12 | 0 | Martensite | 3.3 | 80 | 10,000,000 | 21 | 51 |
| 58 | 14.2 | 0.32 | 0 | Martensite | 3.3 | 80 | 10,000,000 | 23 | 55 |
| 59 | 21.2 | 0.47 | 0 | Martensite | 3.3 | 80 | 10,000,000 | 24 | 59 |
| 60 | 19.5 | 0.43 | 0 | Martensite | 3.4 | 80 | 10,000,000 | 23 | 59 |
| 61 | 10.1 | 0.22 | 0 | Martensite | 3.5 | 80 | 10,000,000 | 23 | 58 |
| 62 | 8.7 | 0.19 | 0 | Martensite | 3.2 | 80 | 10,000,000 | 24 | 58 |
| 63 | 9.0 | 0.20 | 0 | Martensite | 2.9 | 80 | 10,000,000 | 23 | 58 |
| 64 | 8.5 | 0.19 | 0 | Martensite | 2.7 | 80 | 10,000,000 | 23 | 58 |
| 65 | 8.3 | 0.18 | 0 | Martensite | 2.7 | 80 | 10,000,000 | 24 | 58 |
| 66 | 8.0 | 0.18 | 0 | Martensite | 2.8 | 80 | 10,000,000 | 24 | 58 |
| 67 | 8.2 | 0.18 | 0 | Martensite | 3.2 | 80 | 10,000,000 | 24 | 58 |
| 68 | 8.5 | 0.19 | 0 | Martensite | 3.2 | 80 | 10,000,000 | 20 | 51 |
| 69 | 8.6 | 0.19 | 0 | Martensite | 2.8 | 80 | 10,000,000 | 24 | 58 |
| 70 | 8.7 | 0.19 | 0 | Martensite | 3.2 | 80 | 10,000,000 | 23 | 58 |
| 71 | 8.9 | 0.20 | 0 | Martensite | 2.9 | 80 | 10,000,000 | 23 | 58 |
| 72 | 8.5 | 0.19 | 0 | Martensite | 3.2 | 80 | 10,000,000 | 24 | 58 |
| 73 | 8.6 | 0.19 | 0 | Martensite | 3.2 | 80 | 10,000,000 | 24 | 58 |
| 74 | 8.7 | 0.19 | 0 | Martensite | 3.1 | 80 | 10,000,000 | 23 | 58 |
| 75 | 8.7 | 0.19 | 0 | Martensite | 3.2 | 80 | 10,000,000 | 23 | 58 |
| 76 | 14.3 | 0.32 | 0 | Martensite | 3.5 | 80 | 10,000,000 | 21 | 50 |
| 77 | 14.3 | 0.32 | 0 | Martensite | 3.2 | 80 | 3,156,778 | 20 | 48 |
| 78 | 14.3 | 0.32 | 0 | Martensite | 3.1 | 80 | 3,445,678 | 21 | 48 |

The invention claimed is:

1. A steel wire rod or steel bar as hot-rolled, having excellent cold forgeability, comprising:

by mass %, as a chemical composition,

C: 0.1 to 0.6%,

Si: 0.7% to 1.5%,

Mn: 0.05 to 2.5%,

Al: 0.015 to 0.3%,

N: 0.0040 to 0.0150%,

P: limited to 0.035% or less, and

S: limited to 0.025% or less, and a balance consisting of iron and unavoidable impurities, wherein a depth of d (mm) from a surface of a surface layer region with 20 HV 0.2 or more higher, relative to HV 0.2 that is an average hardness in a region where a depth from the surface is from sectional radius R×0.5 (mm) to a center satisfies the following formula (1); a steel structure of the surface layer region has a ferrite fraction of 10% or less by area ratio, with a balance being one or two or more of martensite, bainite and pearlite; the steel structure where the depth from the surface is from the sectional radius R×0.5 (mm) to the center is ferrite-pearlite or ferrite-bainite; and a surface roughness Ra in the circumferential direction when scales adhering to the surface have been removed is 4 μm or less, $$0.5 \geq d/R \geq 0.03 \quad (1).$$

2. The steel wire rod or steel bar according to claim 1, further comprising one or two or more of, by mass %, as the chemical composition of the steel, Cr: 3.0% or less, Mo: 1.5% or less, Cu: 2.0% or less, Ni: 5.0% or less, and B: 0.0035% or less.

3. The steel wire rod or steel bar according to claim 1, further comprising one or two or more of, by mass %, as the chemical composition of the steel, Ca: 0.005% or less, Zr: 0.005% or less, Mg: 0.005% or less, and Rem: 0.015% or less.

4. The steel wire rod or steel bar according to any of claim 1, further comprising one or two or more of, by mass %, as the chemical composition of the steel, Ti: 0.20% or less, Nb: 0.1% or less, V: 1.0% or less, and W: 1.0% or less.

5. The steel wire rod or steel bar according to any of claim 1, further comprising one or two or more of, by mass %, as a chemical composition of the steel, Sb: 0.0150% or less, Sn: 2.0% or less, Zn: 0.5% or less, Te: 0.2% or less, Bi: 0.5% or less, and Pb: 0.5% or less.

6. The steel wire rod or steel bar according to any of claim 1, further satisfying the following formula (2), by mass %, as the chemical composition of the steel, $$31Si+15Mn+23Cr+26Mo+100V \geq 55 \quad \text{Formula (2).}$$

7. The steel wire rod or steel bar according to any of claim 1, further comprising:

by mass %, as the chemical composition of the steel,

Ti: 0.02 to 0.20% and

B: 0.0005 to 0.0035%.

8. The steel wire rod or steel bar according to claim 2, further comprising one or two or more of, by mass %, as the chemical composition of the steel, Ca: 0.005% or less, Zr: 0.005% or less, Mg: 0.005% or less, and Rem: 0.015% or less.

9. The steel wire rod or steel bar according to any of claim 2, further comprising one or two or more of, by mass %, as the chemical composition of the steel, Ti: 0.20% or less, Nb: 0.1% or less, V: 1.0% or less, and W: 1.0% or less.

10. The steel wire rod or steel bar according to any of claim 3, further comprising one or two or more of, by mass %, as the chemical composition of the steel, Ti: 0.20% or less, Nb: 0.1% or less, V: 1.0% or less, and W: 1.0% or less.

11. The steel wire rod or steel bar according to any of claim 2, further comprising one or two or more of, by mass %, as a chemical composition of the steel, Sb: 0.0150% or less, Sn: 2.0% or less, Zn: 0.5% or less, Te: 0.2% or less, Bi: 0.5% or less, and Pb: 0.5% or less.

12. The steel wire rod or steel bar according to any of claim 3, further comprising one or two or more of, by mass %, as a chemical composition of the steel, Sb: 0.0150% or less, Sn: 2.0% or less, Zn: 0.5% or less, Te: 0.2% or less, Bi: 0.5% or less, and Pb: 0.5% or less.

13. The steel wire rod or steel bar according to any of claim 4, further comprising one or two or more of, by mass %, as a chemical composition of the steel, Sb: 0.0150% or less, Sn: 2.0% or less, Zn: 0.5% or less, Te: 0.2% or less, Bi: 0.5% or less, and Pb: 0.5% or less.

14. The steel wire rod or steel bar according to any of claim 2, further satisfying the following formula (2), by mass %, as the chemical composition of the steel, $$31Si+15Mn+23Cr+26Mo+100V \geq 55 \quad \text{Formula (2).}$$

15. The steel wire rod or steel bar according to any of claim 3, further satisfying the following formula (2), by mass %, as the chemical composition of the steel, $$31Si+15Mn+23Cr+26Mo+100V \geq 55 \quad \text{Formula (2).}$$

16. The steel wire rod or steel bar according to any of claim 4, further satisfying the following formula (2), by mass %, as the chemical composition of the steel, $$31Si+15Mn+23Cr+26Mo+100V \geq 55 \quad \text{Formula (2).}$$

17. The steel wire rod or steel bar according to any of claim 5, further satisfying the following formula (2), by mass %, as the chemical composition of the steel, $$31Si+15Mn+23Cr+26Mo+100V \geq 55 \quad \text{Formula (2).}$$

18. The steel wire rod or steel bar according to any of claim 2, further comprising:

by mass %, as the chemical composition of the steel,

Ti: 0.02 to 0.20% and

B: 0.0005 to 0.0035%.

19. The steel wire rod or steel bar according to any of claim 3, further comprising:

by mass %, as the chemical composition of the steel,

Ti: 0.02 to 0.20% and

B: 0.0005 to 0.0035%.

20. The steel wire rod or steel bar according to any of claim 4, further comprising:

by mass %, as the chemical composition of the steel,

Ti: 0.02 to 0.20% and

B: 0.0005 to 0.0035%.

* * * * *